US005765617A

United States Patent [19]

Mierau et al.

[11] Patent Number: 5,765,617

[45] Date of Patent: Jun. 16, 1998

[54] INFEED SYSTEM FOR LUMBER

[75] Inventors: Cameron Dean Mierau; Aki Juhani Anttila, both of Portland; Richard Ichiro Komori, Lake Oswego, all of Oreg.

[73] Assignee: U.S. Natural Resources, Inc., Vancouver, Wash.

[21] Appl. No.: 773,694

[22] Filed: Dec. 27, 1996

[51] Int. Cl.[6] ..... B27B 1/00

[52] U.S. Cl. ..... 144/387; 83/364; 83/367; 1434/3.1; 1434/39; 1434/242.1; 1434/245.2; 1434/250.13; 1434/357; 198/376; 198/434; 198/412; 414/754; 364/474.09

[58] Field of Search ..... 83/364, 357, 367, 83/411.7, 801; 144/3.1, 39, 242.1, 245.2, 246.1, 246.2, 350.13, 356, 357, 387; 198/412, 413, 414, 376, 434, 485; 250/559.22, 559.25; 414/754; 364/474.07, 474.09

[56] References Cited

U.S. PATENT DOCUMENTS

| | | | |
|---|---|---|---|
| 2,876,887 | 3/1959 | Watson . | |
| 4,316,491 | 2/1982 | Kearnes et al. | 144/357 |
| 4,353,276 | 10/1982 | Ackerfeldt . | |
| 4,386,641 | 6/1983 | Horn . | |
| 4,441,537 | 4/1984 | Vartianen . | |
| 4,471,823 | 9/1984 | Wadell . | |
| 4,515,196 | 5/1985 | Shields | 144/378 |
| 4,524,858 | 6/1985 | Maxey . | |
| 4,879,659 | 11/1989 | Bowlin . | |
| 5,232,030 | 8/1993 | Knerr . | |
| 5,421,385 | 6/1995 | McGee . | |
| 5,429,161 | 7/1995 | Allard . | |

*Primary Examiner*—W. Donald Bray
*Attorney, Agent, or Firm*—Robert L. Harrington

[57] ABSTRACT

An infeed system that orients a log for a processing unit. A flight conveyor, a log turner and a sharp chain are in an overlapping arraignment. The flight conveyor conveys a log past a scanner which inputs scan data into a computer which determines the profile and orientation on the flight conveyor. The computer determines the desired orientation of the log for the processing unit. The log turner is arranged to rotate and skew the log to the desired orientation. The log is then transferred to the sharp chain conveyor. The overlapping arrangement of the flight conveyor, log turner and sharp chain maintains full control of the log at all times. The sharp chain conveys the log past a second scanner which inputs the scan data to the computer to determine the actual orientation of the log on the sharp chain. The infeed system may also be provided with a shift and lift mechanism for further controlling the log position relative to the processing unit.

5 Claims, 6 Drawing Sheets

30
44
42

INFEED SYSTEM FOR LUMBER

The prior patent application entitled ASSEMBLY FOR INFEED TABLE, filed Mar 5, 1996 and assigned U.S. Ser. No. 08/610,833, now U.S. Pat. No. 5,649,580 is incorporated herein by reference.

FIELD OF THE INVENTION

This invention relates to a system for determining a desired orientation for a lumber piece to be cut, orienting the logs accordingly and feeding the lumber piece as oriented into a saw; and more particularly it relates to machines and processes for more accurately and more quickly producing these objectives.

BACKGROUND OF THE INVENTION

A primary objective, when processing a log into lumber is to maximize the production from the log, e.g., to obtain the greatest number of lumber pieces. Whereas logs have many different configurations (shapes and profiles), it is beneficial to determine what pattern of lumber pieces that will fit the log's configuration and yield the maximum production. In determining this optimum fit, the position of the log at different rotative and skew orientations should be considered, even considering different cutting configurations, e.g., straight or curved.

A typical infeed system will include a conveyor that conveys a log lengthwise, first through a scanner, the scan data being transmitted to a computer that determines the log shape and profile. The computer further determines what rotative and skew orientation of the log will produce the desired maximum production. The log is then transferred to a log turning machine that turns the log to the desired rotation. The log is transferred to a double length infeed conveyor where the log is lifted and shifted to the desired skew orientation, then to a sharp chain conveyor to insure retention of the log orientation and to convey the log through chippers (where the log is converted to a cant) and/or through a saw (where the log or cant is converted to boards).

A problem with the above process is the physical length of the combined conveyors and machines and the time necessary to convey the log on the conveyors through the various stations. A further concern is the difficulty of retaining the log orientation as it passes from one machine to the other.

BRIEF DESCRIPTION OF THE INVENTION

The present invention, in its preferred form, combines the machines described above into one. A first conveyor section includes a flight chain conveyor that conveys a log through or past a scanner that enables a computer to determine the maximum production of the log and accordingly the rotative and skew orientation necessary to achieve that cutting pattern. This determination may also determine the cutting configuration as between a straight cut or a curved cut. A second section of the machine contains at least a pair of log turners that lift the log from the conveyor and turn it to the desired rotative orientation and also to the desired skew and side shifted orientation of the log for aligning the log with a saw or chipper.

While the log is being conveyed and turned by the log turners, a transition from a flight conveyor to a sharp chain conveyor takes place under the log. The log is lowered back onto the conveyor but now onto a sharp chain portion of the conveyor. Overhead rollers force the log into the desired orientation onto the sharp chain prongs and the log is conveyed into, e.g., a chipper head station.

The above combination of operations is considered to provide distinct advantages for feeding logs to a processing station such as a conventional chipping station or saw. The invention, however, contemplates further improvements in the form of controlled chipping heads. To take advantage of available wood in a curved or tapered log, the chippers desirably will follow the shape of the log and will remove only what cannot be converted to lumber. A tapered 20' log may provide one or more 10' lumber pieces as well as 20' lumber pieces, i.e., by utilizing the larger end of a tapered log. Curved pieces and wider and narrower boards all may be taken from the same log to truly maximize the production from a log. Accordingly, the present invention desirably incorporates top and bottom chippers that independently move up and down in accordance with the log configuration and as instructed by the computer to remove only that wood portion that cannot be used for lumber pieces. The same operability may be provided for the side chippers.

A further improvement includes the incorporation of a second or confirming scanner that scans a portion of a log after it has been oriented by the log turners and impaled onto the sharp chain conveyor. Scanning a few feet only of a log will verify that a log was oriented according to the original determination of the computer. If such orientation has not been achieved, i.e., an error is detected, the scan data can be used to inform the computer of the actual orientation and then the computer would calculate a modified solution. The chippers (or saws) will be reprogrammed accordingly. Further, if the turner always has the same error, then the computer can detect the pattern of error and correct it.

It will be appreciated that the features of the invention may be combined in a number of various ways to suit the need of a particular lumber mill. Such variation of features will become more apparent upon reference to the following detailed description having reference to the accompanying drawings.

DESCRIPTION OF THE PREFERRED EMBODIMENT

Figure 2:
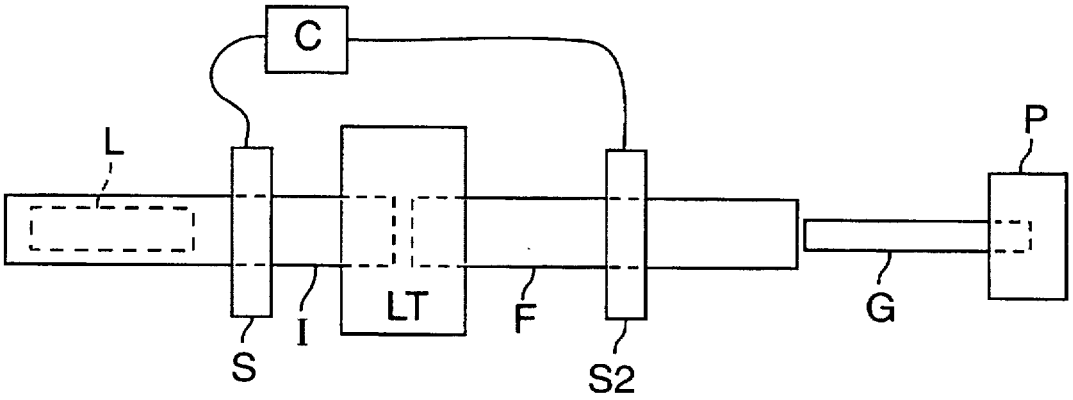
FIG. 2 (Prior Art)
FIG. 2 is a view in diagram form of the prior art.

FIG. 2 illustrates an infeed system of the prior art in diagram form. The infeed system has a scanning conveyor I that receives and transports a log L past or through a scanner S. The scanner S inputs information or data into a computer C and from the data input the computer will determine the profile of the log and the best rotative position of the log for the processing unit P. The scanning conveyor I feeds the log L through a log turner LT which rotates the log L (if required). The log is transferred to a double length infeed conveyor F. The conveyor F transports the log L through or past a second scanner S2 where the log is scanned for shape and profile. The scan data from scanner S2 is utilized to determine board solution from the log, to shift and lift the conveyor F and to set the cutter members of the processing unit P. The log L is transferred to an end conveyor G which transports the log L into the processing unit P.

One of the problems with the above arrangement is the possibility of the log shifting from the desired orientation as the log is transferred from one conveyor to the next. Further, the infeed system of the prior art requires conveyors I, F and G that are a length to handle the maximum length of Log L.

Figure 1:
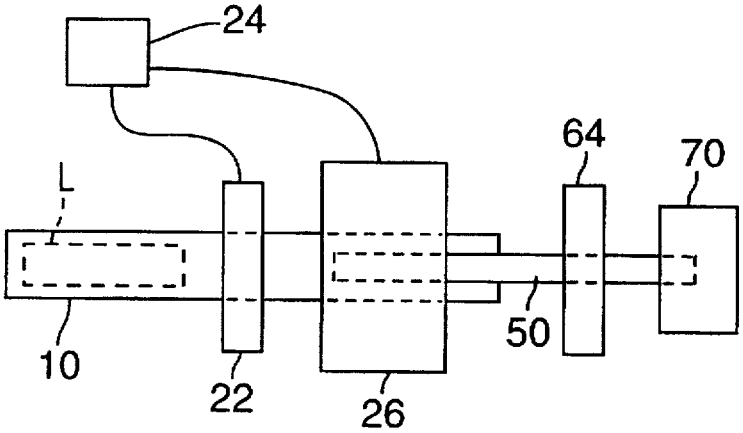
FIG. 1 is a view in diagram form of an infeed system of the present invention.

FIG. 1 illustrates an infeed system in diagram form of the present invention. The conveyors of the infeed system are cooperatively arranged to convey a log, scan the log, reposition the log (if required) by rotation shifting and/or lifting and/or skewing, scan again to check the log position and to convey the log in its optimum position to a processing unit such as a chipper or saw and the like.

As illustrated in FIG. 1, an infeed conveyor 10, a sharp chain conveyor 50 and a log turner 26 are cooperatively arranged to convey a log L under controlled conditions. The infeed conveyor 10 and the sharp chain conveyor 50 are in an over lapping arrangement. The log turner 26 is positioned or mounted at the overlapping portion of the infeed conveyor 10 and the sharp chain conveyor 50. The infeed conveyor 10, the log turner 26 and the sharp chain conveyor 50 are cooperatively arranged to transfer the log L from the infeed conveyor 10 and the log turner 26 onto the sharp chain conveyor 50.

The infeed conveyor 10 receives a log L to be processed and conveys the log L through (or past) a scanner 22. The scanner 22 scans the log L and the scan data is input to a computer 24. The computer 24 determines the shape and profile of the log L and the desired rotation of and shift, lift, skew orientation of the log and the cutting pattern for optimum production of lumber from the log.

The log L progresses to the log turner 26 on the infeed conveyor 10. The computer 24 will, as desired, control the log turner 26 to first elevate the log L off of the infeed conveyor 10, rotate the log L and skew (pivot and or side shift) the log L to position the log L in the desired orientation.

As illustrated the infeed conveyor 10, the log turner 26 and the sharp chain conveyor 50 are in an overlapping arrangement. The log turner 26 being positioned at the over lapping position of both the infeed conveyor 10 and the sharp chain conveyor 50 assures control of the log L throughout the transfer of the log L from the infeed conveyor to the sharp chain conveyor 50. The log turner 26 elevates the log L off the infeed conveyor 10, rotates the log L to the desired rotative position and if necessary skews the log L for proper alignment and then transfers the log L in the desired orientation directly onto the sharp chain conveyor 50. When it is not required to reposition the log L either by rotation or skewing, the log turner 26 will convey the log L in conjunction with the infeed conveyor 10 directly onto the sharp chain conveyor 50.

A second scanner 64 is provided strategic to the sharp chain conveyor 50 to rescan the log L. The second scanner 64 is provided to confirm the orientation of the log L on the sharp chain conveyor 50 and thus only a few feet of the log L need be scanned. The scan data from the scanner 64 is input to the computer 24 and is utilized to determine the actual orientation of the log L on the sharp chain conveyor 50. Should the actual orientation of the log L deviate from the desired orientation, the computer 24 will then control the processing unit 70 according to the actual orientation. The scan data can also be utilized to control or alter the operation of the log turner 26 on subsequent logs L.

The sharp chain conveyor 50 transports and conveys the log L into a lumber processing unit(machine) 70. In this embodiment, the processing unit 70 is a chipper that is arranged to generate four sides on the log L, thus to develop a cant.

The overlapping arrangement of the infeed conveyor 10 and the sharp chain conveyor 50 provides for a much shorter machine length than comparable units of the prior art. Further, the overlapping arrangement of the infeed conveyor 10 and the sharp chain conveyor 50 in conjunction with the log turner 26 maintains control of the log and further assures that the log L will be properly positioned when it is transferred onto the sharp chain conveyor 50.

Figure 3:
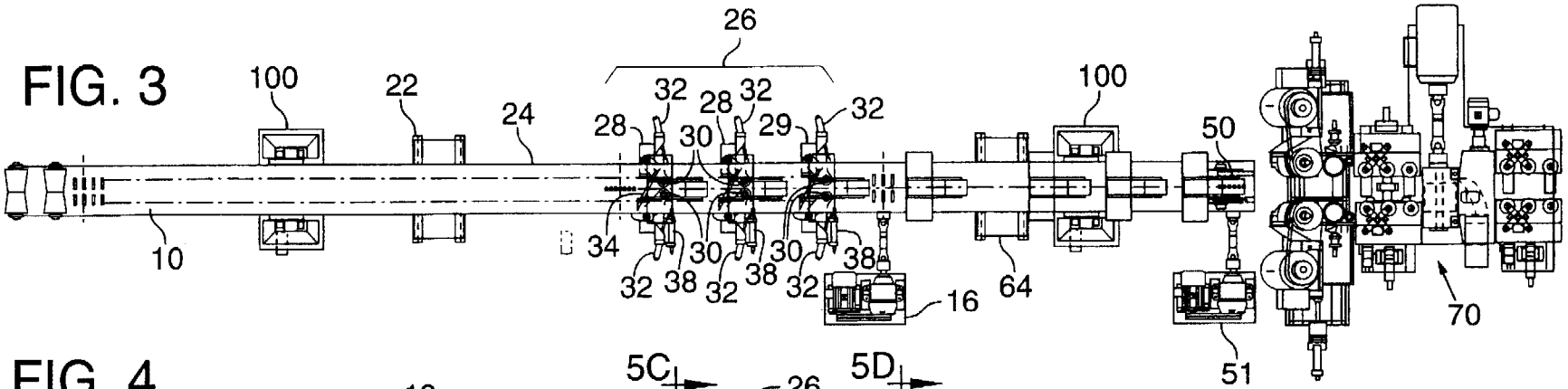
FIG. 3 is a top view of an infeed system of the present invention.
Figure 4:
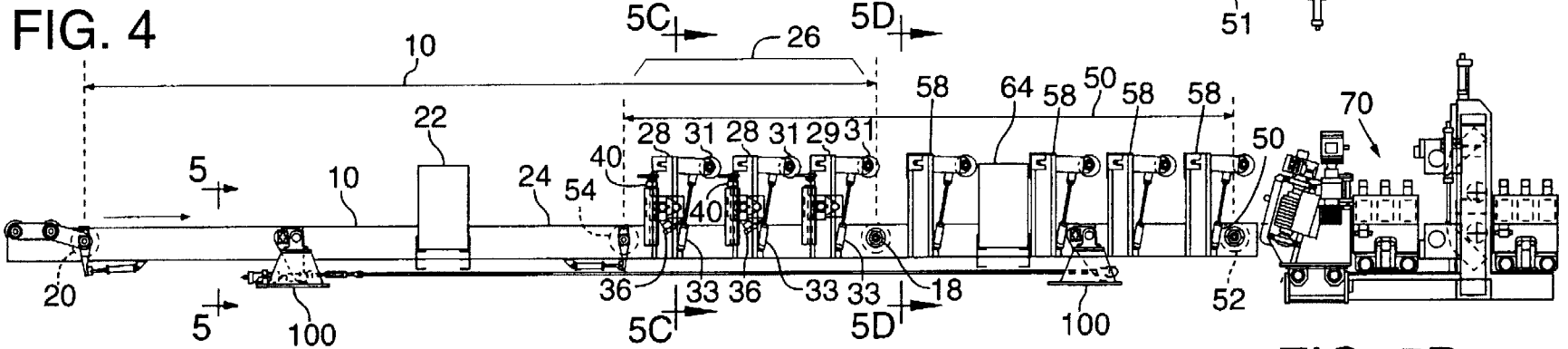
FIG. 4 is a side elevation view of the infeed system of FIG. 3.

Refer now to FIGS. 3 and 4 of the drawings. FIGS. 3 and 4 illustrate one embodiment of the infeed system of the present invention. FIG. 3 is a top plan view of the infeed system of the present invention and FIG. 4 is a side elevation view of the infeed system of FIG. 3.

The infeed system has a flight conveyor 10 for receiving and transporting a log to be processed by a processing unit 70. The conveyor 10 has paired flights 12 (best seen in FIGS. 5A and 5B) that are mounted to chains 14. The chains 14 are entrained around a drive sprocket 18 and a return sprocket 20. The flights 12 are supported on decks 15. The decks 15 are inclined downwardly toward the center as indicated by angle A in FIG. 5B such that the flights 12 residing on the decks 15 will form a Vee for supporting the log L. The angle of inclination of the decks 15 may be varied along the length of the conveyor 10 to alter the Vee formation formed by the flights 12. The decks 15 may, for example, have a greater angle of inclination at the entry end of the conveyor 10 (near return sprocket 20) and have little or no angle of inclination where the conveyor 10 and the log turner 26 are in an over lapping arrangement. The decks 15 and thus the flights 12 are preferably at a near level attitude at the log turner 26 to enable the log turner 26 to more readily engage a small diameter log L. There is a space 13 between the paired flights 12 that is sufficiently wide to receive a sharp chain conveyor 50. The conveyor 10 is driven by a drive mechanism 16 in a conventional manner. The drive mechanism 16 is coupled to the drive sprocket 18 (best seen in FIG. 3).

A scanner 22 is mounted strategic to the conveyor 10 and is arranged to scan the log L as it is conveyed past or through the scanner 22. The scanner 22 inputs scan data to a computer 24 (See FIG. 1). The computer 24 will process the scan data to determine the shape and profile of the log L being conveyed on the conveyor 10 and further will determine the orientation of the log L on the conveyor 10.

A log turner 26 is provided downstream from the scanner 22 and is capable of altering the position of the log L (if required) on the conveyor 10 for delivery of the log to the sharp chain conveyor 50. As shown in FIGS. 3 and 4, the infeed conveyor 10, the log turner 26 and the sharp chain conveyor 50 are in an over-lapping arrangement.

Figure 5D:
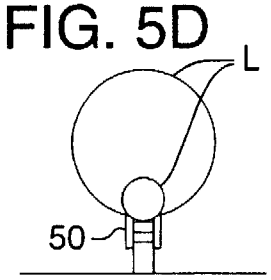
FIG. 5D is a view similar to FIG. 5C but illustrating the log transferred to a sharp chain conveyor as occurs after turning of the log.
Figure 5C:
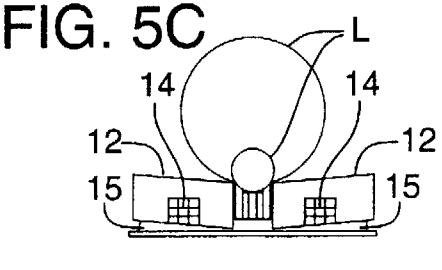
FIG. 5C is a view similar to FIG. 5B as viewed on view lines 5C—5C of FIG. 4.
Figure 5B:
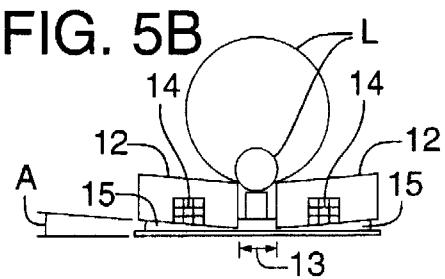
FIG. 5B is an enlarged view similar to FIG. 5A with portions removed.
Figure 5A:
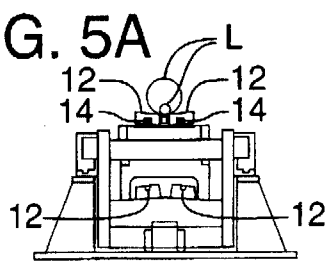
FIG. 5A is a view as viewed on view lines 5—5 of FIG. 4 but illustrating a log of minimum and maximum proportions carried by the conveyor.

Referring again to FIGS. 3, 4 and 5 the sharp chain conveyor 50 extends from a drive sprocket 52 to a return sprocket 54 and is driven by a conventional drive mechanism 51. As shown in the figures, the sharp chain 50 overlaps and extends between the flights 12 of the conveyor 10 in the area of the log turner 26. The sharp chain 50 in the vicinity of the return sprocket 54 will be below the upper surface of the flights 12 of the conveyor 10. The sharp chain 50 is arranged to elevate as the sharp chain approaches the drive sprocket 18 of the conveyor 10 such that the sharp chain 50 will be extended above the flights 12 of the conveyor 10 as shown in FIG. 5D. The log turner 26 elevates, rotates and skews the log L, and then deposits the log L upon the sharp chain 50.

Figure 9:
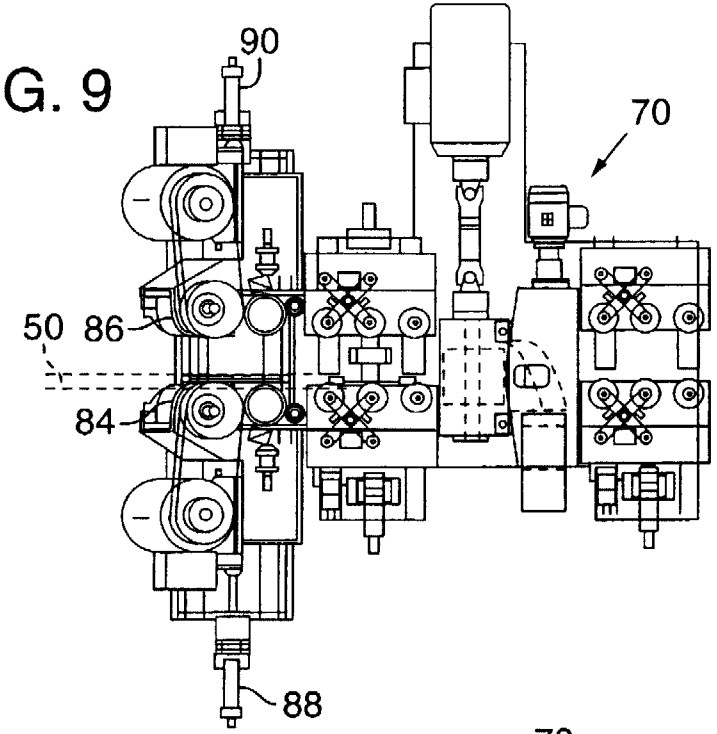
FIGS. 7, 8, 9 and 10 are views of a chipper unit incorporated in the infeed system of FIGS. 3 and 4.

The sharp chain conveyor 50 may also be extended into the processing unit 70 as indicated in dashed lines in FIG. 9. The log L is then accurately transported through the side heads 84, 86.

In this embodiment, the log turner 26 has two individual assemblies 28. Each assembly 28 has opposed rollers 30 that are adjustably mounted and are arranged to engage the log L. The rollers 30 are adjusted toward and away from the center line of the conveyor 10 by individual cylinders 32. The opposed rollers 30 of each assembly 28 are further coupled together by a tie rod 34. The rollers 30 are rotatively driven in a conventional manner and have a normal axis of rotation that is normal to the surface of the conveyor 10. The axis of rotation of the rollers 30 may be adjusted by a cylinder 36 (see FIG. 4) such that the axis of rotation of the rollers 30 may be inclined in either direction from a reference plane normal to the conveyor 10. Each assembly 28, and thus the roller sets 30, may be moved laterally relative to the conveyor 10 by a cylinder 38. The roller sets 30 of the assemblies 28 are further adjustable upwardly and downwardly by a cylinder 40.

Figures 6A, 6B, 6C, 6D:
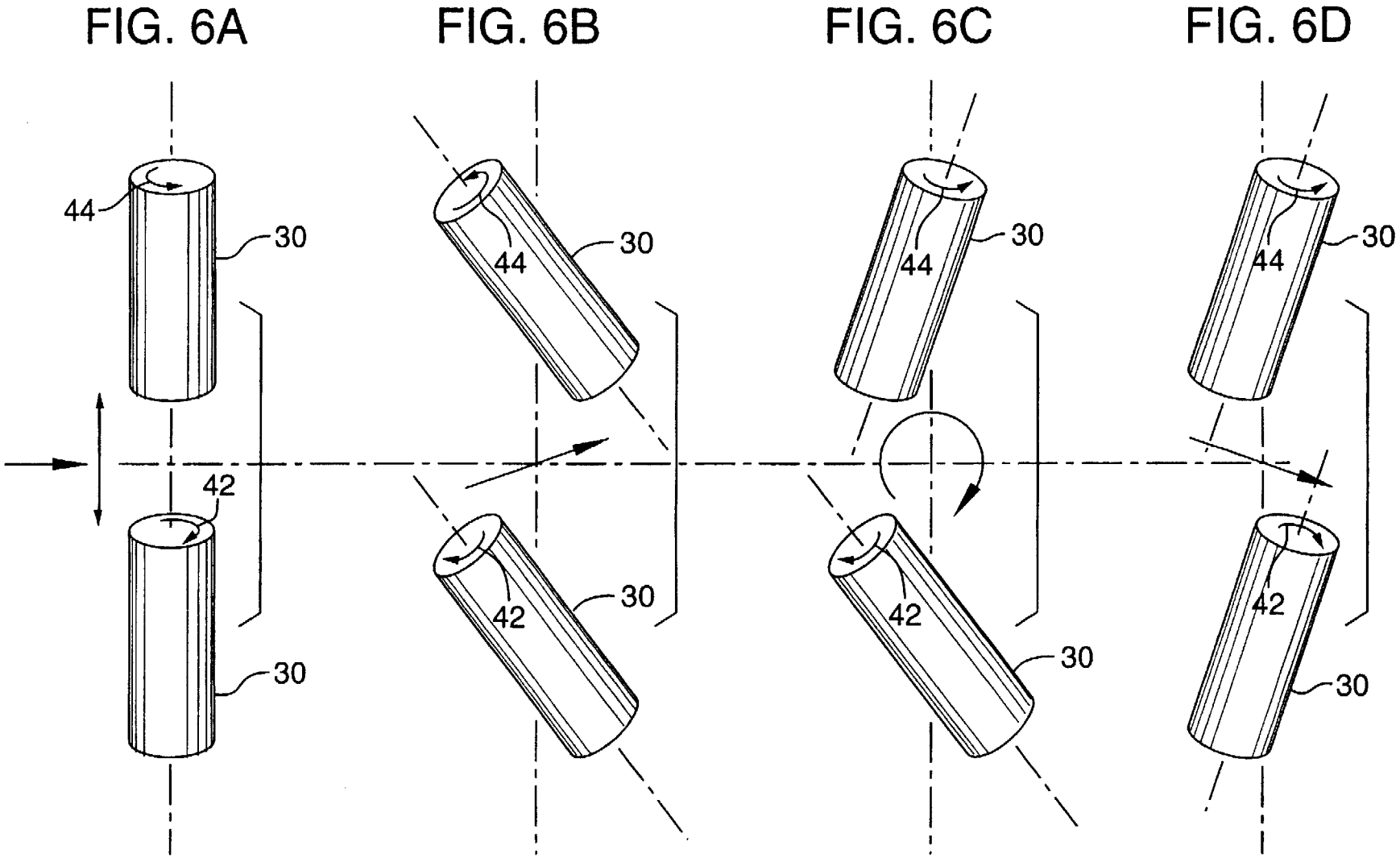
FIGS. 6A–6D are views illustrating in diagram form, the roller sets of a log turner of the infeed system of FIGS. 3 and 4.

FIGS. 6A–6D schematically illustrate in perspective some of the possible positions of the opposed roller sets 30. FIG. 6A illustrates the roller sets 30 in their normal attitude, that is with their axis of rotation normal to the surface of the conveyor 10. The opposed rollers 30 are counter rotated as indicated by arrows 42 and 44. The opposed roller sets 30 in this attitude will engage the log L and assist in conveying the log L along the length of the conveyor 10. FIG. 6B illustrates the roller sets 30 inclined at an angle with respect to the normal vertical axis of rotation. The opposed roller sets 30 inclined at such an angle and rotated in the directions indicated by arrows 42, 44 will engage and lift the log L upwardly off of the conveyor 10. It will be appreciated that only one roller set 30 of the two assemblies 28 is illustrated. However, the opposed roller sets of the other assembly 28 will also be in engagement with the log L to lift the log L off of the conveyor 10. The log L is elevated or lifted off of the flights 12 of the conveyor 10 to permit rotating the log L and/or skewing the log L relative to the conveyor 10 to reposition the log L to the desired orientation as determined by the computer 24. With the log L being lifted by the opposed roller sets 30 of the assemblies 28, the log may be skewed laterally or pivoted in either direction by operation of the cylinder 38 of the assemblies 28.

The roller assembly 31 is raised and lowered by a cylinder 33. The log L may also be rotated by the opposed roller sets 30 and the arrangement of the roller sets 30 for rotating the log L is illustrated in FIG. 6C. As shown, one roller 30 is tilted in one direction from the vertical axis of rotation and the other roller 30 is tilted in the opposite direction from the vertical axis of rotation. It will be appreciated that to rotate the log in the opposite direction, the roller sets 30 would be inclined in the opposite directions. Log L thus captive between the roller sets 30 will rotate due to the forces exerted on the log L by the roller sets 30. When the log L has been rotated to the proper position and/or skewed as required, the opposed roller sets are inclined at an angle as illustrated in FIG. 6D. With the roller sets 30 inclined at the angle indicated in FIG. 6D, the log will descend back down upon the over lapping conveyors 10 and 50. Then roller 31 comes down to impale the log L on the sharp chain 50.

The log turner 26 includes an assembly 29 that is similar to assembly 28. The assembly 29 aids in conveying the log L during the transition from the conveyor 10 to the sharp chain conveyor 50. The assembly 29 has opposed rollers 30 that are movable toward and away from each other (by cylinders 32). The assembly 29 also has a hold down roller assembly 31 that is movable upwardly and downwardly by cylinder 33. The assembly 29 aids in maintaining the log L in the adjusted position as the log L is transferred from the infeed conveyor 10 to the sharp chain conveyor 50.

The log turner 26 in addition to rotating and skewing the log L is conveying the log L along the overlapping conveyors 10 and 50. The sharp chain conveyor 50 is at an elevation above the flights 12 of the infeed conveyor 10 whereat the log descends and the log L will therefore be impaled upon the sharp chain conveyor 50. The hold down rollers 31 (of the assemblies 28, 29) will be forced downwardly upon the log L to impale the log L on the sharp chain 50.

As shown in the figures, the sharp chain 50 overlaps and extends between the flights 12 of the conveyor 10 in the area of the log turner 26. The sharp chain 50 in the vicinity of the return sprocket 54 will be below the upper surface of the flights 12 of the conveyor 10. The sharp chain 50 is arranged to elevate as the sharp chain approaches the drive sprocket 18 of the conveyor 10 such that the sharp chain 50 will be extended above the flights 12 of the conveyor 10 as shown in FIG. 5D. The log turner 26 elevates, rotates and skews the log L as described, and then deposits the log L upon the sharp chain 50. The hold down rollers 31 as previously mentioned force the log L onto the sharp chain 50 and hold the log L in position on the sharp chain 50. Additional hold down roller sets 58 are provided along the length of the sharp chain 50 to maintain the log L in its proper attitude. The sharp chain conveyor 50 is in effect a clamping conveyor. The log L being impaled on the sharp chain and further being retained by the roller sets 58 clamps or is held in the oriented position on the sharp chain conveyor 50.

A secondary scanner 64 is mounted strategic to the sharp chain 50 and is arranged to scan the log L as it passes through or by the scanner 64. The scan data from the scanner 64 is input to the computer 24 and is utilized to determine the actual position of the log L on the sharp chain 50. The scan data from the scanner 64 provides data for the computer 24 to ascertain whether the log L is in its desired position and provides secondary information for the computer to control the processing unit 70 and/or the log turner 26. Should the log L be out of its desired orientation, the computer 24 will alter the program for the processing unit 70 to process the log L. The scan data from the scanner 64 also provides information to the computer 24 to vary or alter the program of the log turner 26 for subsequent logs. The sharp chain 50 conveys the log L into or onto the processing unit 70 down line from the infeed system.

Figure 7:
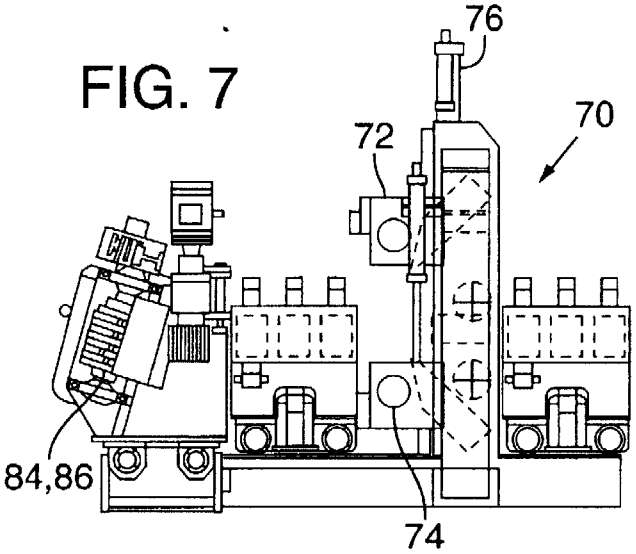
Figure 8:
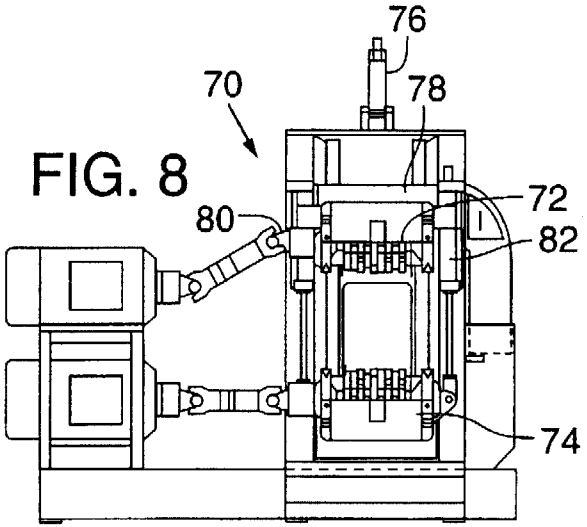

The processing unit in this embodiment is a chipper 70 as illustrated in FIG. 7. The chipper 70 has an upper chipper 72 and a lower chipper 74. The chippers 72, 74 are movable upwardly and downwardly either in unison or singly. Referring to FIG. 8, a cylinder 76 is coupled to a carriage 78 on which the chippers 72, 74 are mounted. The cylinder 76 will thus move the chippers 72, 74 in unison either upwardly or downwardly. Cylinders 80, 82 mounted on the carriage 78 and coupled to the lower chipper 74 are arranged to move the lower chipper 74 relative to the upper chipper 72. The upper chipper 72 and the lower chipper 74 thus may be moved independently either upwardly and downwardly by the cooperative operation of the cylinders 76, 80, 82 and additionally they may be moved in unison either upwardly or downwardly by operation of the cylinder 76 only.

Figure 10:
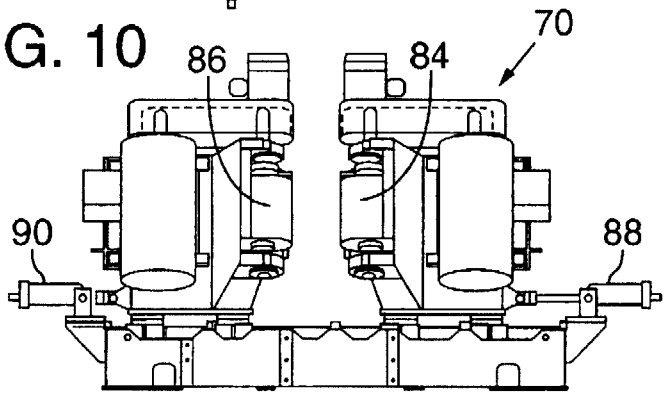

The chipper 70 also has side chippers 84, 86 that are adjustably mounted and are movable toward and away from each other. As seen in FIGS. 9 and 10, the cylinders 88, 90 are provided to move the side chippers 84, 86. Cylinders 88, 90 operating in conjunction with each other permit moving the side chippers 84, 86 toward each other, permit moving the side chippers 84, 86 away from each other and permit shifting the side chippers 84, 86 in unison in either direction. The side chippers 84, 86 are also independently movable by operation of the cylinders 88, 90 independently.

The arrangement of the chipper 70 with its movable upper and lower chippers 72, 74 and the movable side chippers 84, 86 permits generating cants from a log L having many different configurations.

Figure 11:
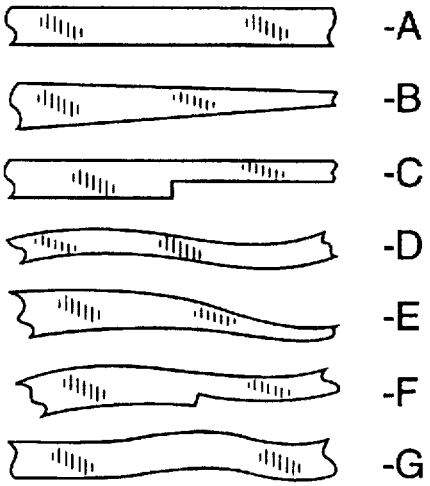
FIG. 11 illustrates a sampling of the surfaces that are attainable by the system of FIGS. 3 and 4.
Figure 12:
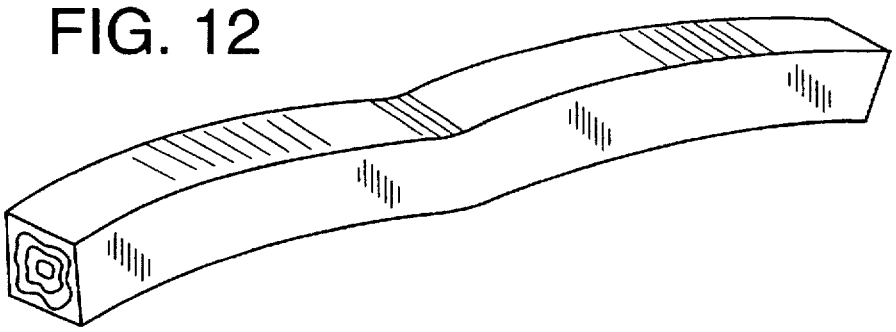
FIG. 12 illustrates a sample of a resulting cant that could be produced by the system of FIGS. 3 and 4.

FIG. 11 illustrates but a few of the possibilities. As illustrated, the opposed surfaces, that is the top and bottom and/or the opposed sides of the generated surfaces can be straight and parallel as indicated by example A, straight and tapered as illustrated by example B, straight and stepped as illustrated by example C, curved and parallel as illustrated by example D, curved and tapered as illustrated by example E, curved and stepped as illustrated by example F and/or straight and curved as illustrated by example G. The generated surfaces are not limited to a particular example but may be a combination of any or all of the examples for the same log L. It will be appreciated that other combinations of surfaces generated by the controlled action of the chipper unit 70 may be achieved. The surfaces generated will be determined in part by the shape and profile of the log L to be processed, the desired end products from the log and so forth. FIG. 12 for example illustrates surfaces generated that are curved in the horizontal and vertical planes.

Figure 13:
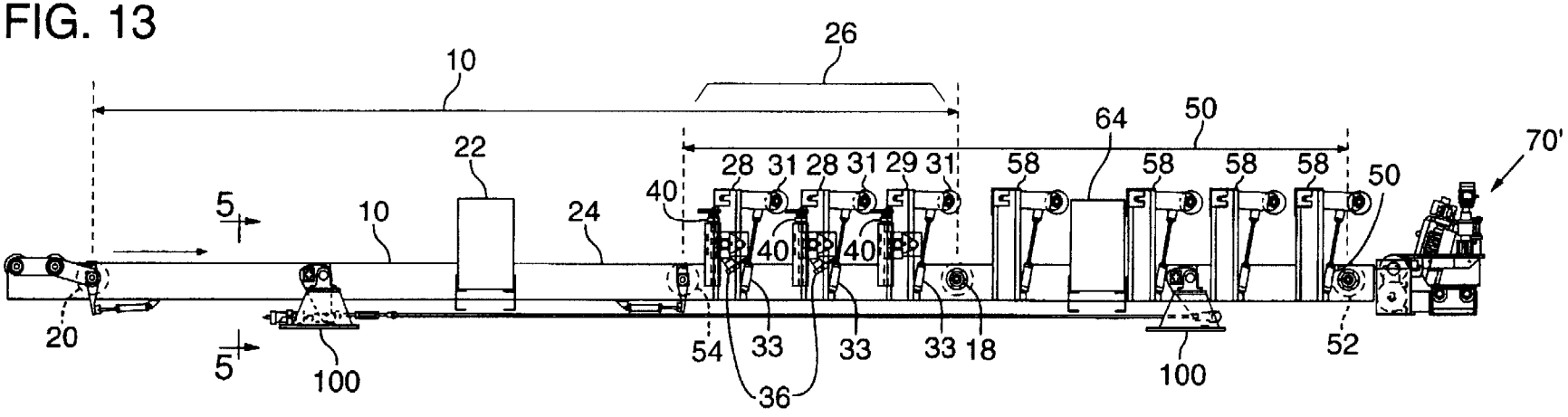
FIG. 13 illustrates another embodiment of the infeed system.

There are existing processing units such as chippers that do not have movable bottom chipper heads. FIG. 13 illustrates an infeed system that in addition to the log positioning capability of the over lapping units of the infeed conveyor 10, log turner 26 and sharp chain 50 has a shift and lift mechanism 100. The shift and lift mechanism is of the type disclosed in U.S. patent application titled Assembly for Infeed Saw, Ser. No. 08/610833. The shift and lift mechanism is also illustrated in FIGS. 3 and 4. The shift and lift mechanism 100 is provided to elevate and lower the infeed system as well as shift the infeed system laterally relative to the feed path and the processing unit. This provides the added capability of shifting the log L laterally, and/or elevating or lowering the log L relative to the processing unit 70'. The shift and lift mechanism is also suited for other processing units such as saws and the like where log position prior to feeding it into a processing unit may require adjustment to obtain the optimum or desired end products from the log L. It may also be used to correct the shift of log done by log turners.

Those skilled in the art will recognize that modifications and variations may be made without departing from the true spirit and scope of the invention. The invention is therefore not to be limited to the embodiments described and illustrated, but is to be determined from the appended claims.

We claim:

1. A system for receiving, scanning and orienting a log for optimum utilization of a log to be converted to lumber comprising:

a scanner scanning a log and determining a desired orientation for processing the log, a log turner, a flight conveyor for conveying a log from the scanner and into the log turner, and a sharp chain conveyor overlapping and merging with the first flight conveyor in the area of the log turner and conveying the log away from said log turner, said log turner functioning to raise a log off the flight conveyor and continuing to convey the log while orienting the log as determined by the scanner, and then lowering the log onto the sharp chain conveyor whereby the log is impaled onto the sharp chain conveyor at the determined orientation for feeding thereof to a log processing machine.

2. A system for receiving, scanning and orienting a log for optimum utilization of a log to be converted to lumber comprising:

a scanner, a log turner, a first conveyor conveying a log from the scanner and to the log turner that lifts and orients the log while continuing conveyance of the log, and a second clamping conveyor receiving the log following orientation and conveying the log to a log processing machine;

said log turner including side shifting mechanisms that side shift and skew a log as desired relative to the conveyor in addition to rotative orientation thereof.

3. A system for receiving, scanning and orienting a log for optimum utilization of a log to be converted to lumber comprising:

a scanner, a log turner and a unified assembly of conveyors including a first conveyor conveying a log through the scanner and to the log turner that lifts and orients the logs while continuing to convey the logs, and a second clamping conveyor receiving the log following orientation and conveying the log to a log processing machine; and a second scanner scanning the log following turning thereof to verify the proper orientation of the log.

4. A system for converting a log into a four-sided cant comprising:

a conveyor, a scanner, a computer and a chipping station, said conveyor conveying the log from the scanner, and said computer determining from the scanner a desired shape and profile of a cant to be produced from the log; and said chipping station including side chippers and top and bottom chippers for producing the four sides of a cant, said side chippers and said top and bottom chippers independently movable during chipping of the log, and in accordance with the shape and profile determined by the computer, producing curved sides on any and all of the four sides of the log corresponding to the desired shape and profile of the cant.

5. A system for converting a log into a four-sided cant as defined in claim 4, further including:

a shift and lift mechanism for lifting and shifting the system relative to said chipping station.

* * * * *